US005491530A

United States Patent [19]

Earle et al.

[11] Patent Number: 5,491,530

[45] Date of Patent: Feb. 13, 1996

[54] PROCESSING OF PHOTOGRAPHIC FILM

[75] Inventors: Anthony Earle, Harrow; Christopher M. Graebe, Berkhamstead; Edward C. T. S. Glover, London; David A. Skye, Harpenden; Nicholas J. Taylor, Harrow Weald; Paul C. Ward, Oxhey, all of England

[73] Assignee: Eastman Kodak Company, Rochester, N.Y.

[21] Appl. No.: 196,088

[22] PCT Filed: Aug. 17, 1992

[86] PCT No.: PCT/EP92/02027

§ 371 Date: Apr. 23, 1994

§ 102(e) Date: Apr. 23, 1994

[87] PCT Pub. No.: WO93/04404

PCT Pub. Date: Mar. 4, 1993

[30] Foreign Application Priority Data

Aug. 20, 1991 [GB] United Kingdom ..... 9117940

[51] Int. Cl.[6] ..... G03D 17/00

[52] U.S. Cl. ..... 354/313; 354/320; 354/324

[58] Field of Search ..... 354/298, 299, 354/312, 313, 323, 324, 331, 336, 310, 322; 134/64 R, 122 R, 122 P; 242/67.1

[56] References Cited

U.S. PATENT DOCUMENTS

| | | | |
|---|---|---|---|
| 1,304,032 | 5/1919 | Edelman | 354/310 |
| 2,082,962 | 6/1937 | Lesjak et al. | 354/313 |
| 2,769,381 | 11/1956 | Lesjak | 354/313 |
| 3,260,186 | 7/1966 | Lowell | 354/313 |
| 3,563,486 | 2/1971 | Meeussen et al. | 242/67.1 |
| 3,724,354 | 4/1973 | Smith | 354/323 X |
| 3,828,172 | 8/1974 | Schickler | 354/324 X |
| 3,890,629 | 6/1975 | Huss | 354/323 |
| 3,906,966 | 9/1975 | Drake et al. | 354/314 X |
| 4,035,818 | 7/1977 | King | 354/323 |
| 4,104,670 | 8/1978 | Charnley et al. | 354/324 |
| 4,128,325 | 12/1978 | Melander et al. | 354/324 X |
| 4,332,456 | 6/1982 | Kaufmann | 354/298 |
| 4,350,429 | 9/1982 | Slavin | 354/299 |
| 4,402,590 | 9/1983 | Rubin | 354/324 |
| 4,423,944 | 1/1984 | Waters, Jr. | 354/323 X |
| 4,428,658 | 1/1984 | Moore et al. | 354/313 X |
| 4,453,817 | 6/1984 | Clark | 354/299 |
| 4,494,845 | 1/1985 | Aoki et al. | 354/297 |
| 4,740,074 | 4/1988 | Powell | 354/313 X |
| 4,888,607 | 12/1989 | Stutz et al. | 354/323 |
| 4,890,131 | 12/1989 | Kuzyk et al. | 354/323 X |
| 5,363,168 | 11/1994 | Glover et al. | 354/319 |

FOREIGN PATENT DOCUMENTS

| | | |
|---|---|---|
| 2003262 | 8/1971 | Germany . |
| 3002450A1 | 8/1981 | Germany . |

*Primary Examiner*—D. Rutledge
*Attorney, Agent, or Firm*—Frank Pincelli

[57] ABSTRACT

Described herein is a portable film processing arrangement which is housed in a case-like receptacle comprising a base portion and a lid portion. Base portion 10 houses a plurality of processing units 30 which accommodate spiral holders onto which film to be processed can be wound automatically. Lid portion 14 houses a plurality of containers 18,19,20 which contain processing chemicals for processing the film. The chemicals are fed to the processing units 30 from the containers 18,19,20 as required by valves which are controlled by an on-board computer in a control section 45 located in the base portion 10 between the processing units 30.

8 Claims, 2 Drawing Sheets

PROCESSING OF PHOTOGRAPHIC FILM

BACKGROUND OF THE INVENTION

This invention relates to the processing of photographic film. The invention particularly relates to a processing unit for processing photographic film which is portable.

There are several different ways in which the processing of photographic film can be achieved. A common way is to send the film to a processing laboratory where typically it will be processed in a large processing unit. On a smaller scale a photographic film can be wound on to elements such as spiral reels and processed in a small light tight tank. The chemicals used in the processing have to be mixed, raised to the correct temperature and the whole process operated with a timer and thermometer.

Also small processors are available, but again these need the chemicals to be mixed and they require connection to a water supply and have to be operated in a dark room for the loading of a film. Usually they also require a mains type electrical supply.

In a typical portable machine each film for processing is loaded onto a spiral in the dark usually in a dark room. Chemicals are supplied to the machine from external containers and typically the chemicals will be supplied as concentrates which are diluted to the correct concentration. As a rinse is used after every stage to overcome contamination the machines require connection to a water supply. This can make the process time consuming and large volumes of effluent have to be discharged. Finally the film requires removal for a drying step.

SUMMARY OF THE INVENTION

The present invention is concerned with a portable processing unit which attempts to alleviate some of these disadvantages.

According to the present invention there is provided a film processing unit comprising means for receiving a cassette containing undeveloped film, means for removing said film from said cassette and winding said film onto a spiral type holder located in a processing chamber, said loading means, said removal means and said processing chamber being housed in light tight conditions, receptacle means for containing processing fluid, means coupling the receptacle means to the processing chamber, valve means for selectively permitting flow of processing fluids between said receptacle means and said processing chamber, the arrangement being such that processing fluids can be dispensed from said receptacle to said processing chamber to perform a processing operation on said film and after said operation said fluid can be returned to its respective receptacle means or otherwise discharged.

BRIEF DESCRIPTION OF THE DRAWINGS

The invention will be described now by way of example only, with particular reference to the accompanying drawings. In the drawings.

DETAILED DESCRIPTION OF THE INVENTION

Figure 1:
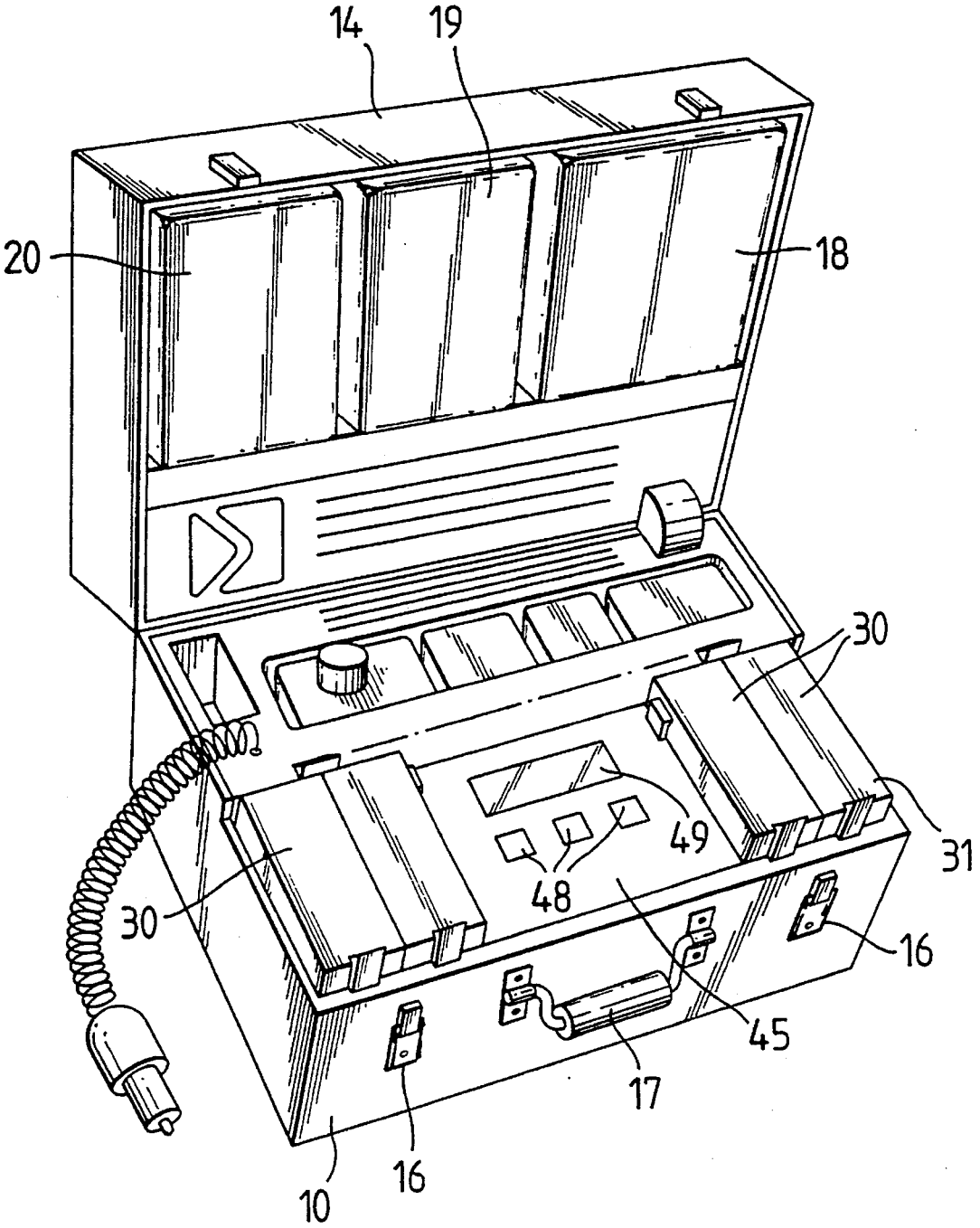
FIG. 1 is a perspective view of a portable processing unit in accordance with the present invention.
Figure 2:
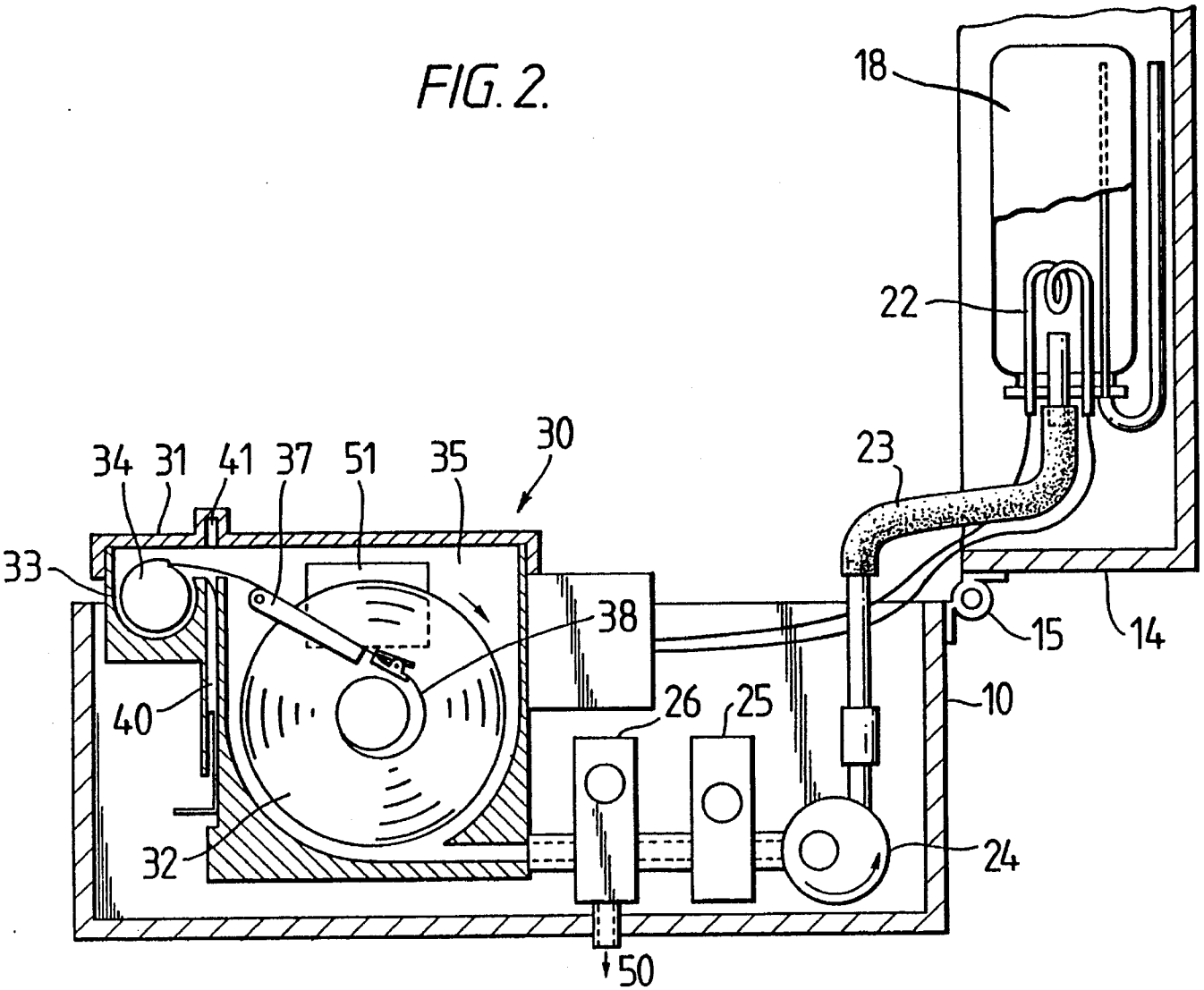
FIG. 2 is a sectional view of the processing unit.

Referring to the drawings the processing unit is in the form of a case like container having a base section (10) and a lid section (14) connected to the base by hinges (15). The base section (10) and the lid section (14) each define volumes within which are located elements which make up a self-contained photographic film processing unit. The case includes catches (16) for securing the lid to the base and a handle (17) for carrying the case.

The lid section (14) houses three containers (18, 19, 20) each provided to accommodate chemicals used in the developing process. Each container (18) can include a heating element (22) which when energised acts to heat the solution contained in it to a desired temperature. Also each container is connected at its lower end to a conduit (23) which extends from the lid section to a pump (24) disposed in the base section. The pump is coupled by a first valve (25) and a three-way valve (26) to a processing unit (30). As can be seen in FIG. 1 of the drawings four such processing units are located in the base section. The processing units (30) are arranged in spaced apart pairs, one adjacent each side wall of the base section.

Each processing unit (30) is defined by a light tight container having a lid (31). The container defines a chamber (35) in which is located a spiral type reel (32) which can be mounted so as to be rotatable about its axis. The case can include drive means for rotating the spiral (32) about its axis. The container (30) also defines a smaller chamber (33) within which can be disposed a cassette (34) containing film to be developed. Film extends from the cassette (34) to the spiral (32) by way of a loading shute (37). The loading shute (37) is designed to bow the film slightly as it is fed to the spiral (32) thereby facilitating passage of the film between and into the side walls of the spiral. The end of the film is connected to the spiral by clipping it to a belt (38).

Associated with each unit (30) is a manually operable knife (40) which can be used to cut the end of a film after it has been wound onto the spiral (32). A recess (41) is provided in the lid (31) above the knife. The cutting edge of the knife when it is moved upwardly can enter the recess (41) thereby facilitating the cutting operation.

Disposed between the spaced apart pairs of processing units (30) is a control section (45). This control section includes a microcomputer and associated memory. Instructions and data can be fed into the microcomputer by way of keys (48) and a display (49) is also provided. This can be a liquid crystal type display.

The computer is programmed to control developing process. It can output signals for controlling the valves (25, 26) and the pump (24) and also to control the heating of the chemicals in the containers (18, 19, and 20). The computer can also receive inputs from various sensors provided in the processing unit which can sense for example when the latching levers of the lid have been closed or when the drive to the spirals.

In use the unit is operated with lid (14) open. Appropriate chemicals are placed in the containers (18, 19, and 20) and are supplied in a form which requires no further additions of water. This means that once the solutions are in the containers no further contact from the operator is required. When required the solutions in the containers are heated by the 12 volt heater (22) whose operation is regulated by the temperature probe which feeds temperature data to the computer control. A cassette (34) containing the film to be processed is located in the compartment (33) provided for this purpose. A length of film is drawn out from the cassette and fed via the shute (37) and connected to the belt (38) on the spiral (32). The lid (31) is then closed on that processing unit. The spiral is then rotated by appropriate drive means and the film is drawn from the cassette (34) and wound onto the spiral. As has been explained the shute acts to assist this operation by bowing the film so that it can be fed correctly between the lands which are formed on the spiral. When the film has been completely drawn out from the cassette (34) this is sensed and the drive to the spiral is declutched. The film can then be cut by operating the knife (40). If necessary a further film can then be loaded in a simpler manner to one of the other processing units (30).

At this point in the operation the computer will by way of the display (49) inform the operator of its status and call for the operator to input the type of film and the type of process required. The machine can be arranged so that it is always ready to process film irrespective of the temperature of the chemicals in the containers (18, 19, and 20). The computer control can be programmed to automatically adjust the processing time to take account of temperature of the chemicals and their state of exhaustion. However in normal operation the machine should have been left on standby and the chemicals preheated to the optimum temperature. When the operator has inputted the type of film and process required the delivery of chemicals from the containers (18, 19 and 20) to the processing units (30) takes place. This occurs under the influence of gravity. The chemicals are fed by way of the valves (25 and 26) to the chamber (35). A level detector is provided to sense the level of liquid in the chamber and at an appropriate time causes the valve (25) to close so that no more liquid is fed to the processing unit. When the liquid has reached the desired level the process treatment starts with the spiral (32) rotating. After a predetermined time determined by the computer control the valve (15) is again opened and the pump (24) starts operating. This causes the chemical to be pumped back to the appropriate container (18, 19 or 20) following which the valve (25) is closed and the valve (26) is operated to select an outlet (50) through which any remaining chemicals can drain. Further chemicals can be fed into the unit (30) in a similar manner to complete the developing process, each container has its own valve and pump station.

The unit can be provided with a heater to supply hot air to the film held on the spiral in the processing unit (30). This air can be forced in by means of a fan heater (not shown) the air being fed into the chamber (35) by way of light traps behind an inlet (51). Air can exhaust via a vent with light traps in an opposite wall. Alternatively the film can be taken out wet if desired.

To remove the processed film the lids (31) are unlocked and the spiral removed and the film unwound from the spiral.

It should be noted that the pairs of units (30) can be arranged so that one part may be operating one process at the same time as the other part is operating another different process. One such process may be stopped without the other having to be interrupted.

It will be appreciated that after use the case lid can be closed and latched and the whole unit taken to another location if necessary. Bottles containing used chemicals can be removed by inverting and unplugging them and new chemicals located therein.

The apparatus described above has a number of features which are considered to be significant inventive both singly and in combination. These include the following:

The provision of a self-contained photographic film processing unit which does not require a dark room for its operation. The unit can be operated from a 12 volt supply such as a car battery.

The provision of such a processing unit in which the chemicals are supplied ready mixed.

A portable processing unit having automatic processor control. The use of processor control allows the unit to adopt a low temperature start up process which may be necessary if film is required quickly before the developing chemicals have reached an optimum temperature.

The unit can be used at low power and low voltage and the computer can be designed to carry out a power sharing function to conserve power.

The unit can have two film processing stations running in parallel. It is possible to stop one processing station and remove the film from that station while film is still being developed in the other station.

We claim:

1. A portable film processing unit comprising:

loading means for receiving a film cassette containing undeveloped film;

at least one processing chamber;

at least one receptacle means for containing processing fluids;

coupling means for coupling each receptacle means to each processing chamber;

valve means for selectively permitting flow of processing fluids between each receptacle means and a respective one of the processing chambers;

removal means for removing the film from its cassette and winding it onto a spiral type holder located in a processing chamber, the loading means, the removal means, and the processing chambers being housed in light-tight conditions; and pump means to facilitate the flow of processing fluid from the processing chamber to respective receptacle means, the arrangement being such that the processing fluids can be dispensed from the receptacle means to a selected one of the processing chambers to perform a processing operation on the film therein and, on completion of that processing operation, the fluid can be returned under the influence of the pump means to its respective receptacle means.

2. A portable film processing unit according to claim 1, wherein a plurality of processing chambers are provided.

3. A portable film processing unit according to claim 2, wherein four processing chambers are provided, the processing chambers being arranged in pairs to that one pair of chambers may operate a process which is different to that operated by the other pair.

4. A portable film processing unit according to claim 1, wherein heaters are provided to heat the processing fluids in the receptacle means.

5. a portable film processing unit according to claim 1, wherein cutting means are provided to cut the film from its cassette after the film has been wound onto the spiral type holder.

6. A portable film processing unit according to claim 1, wherein drying means are provided to dry the film after processing.

7. A portable film processing unit according to claim 1, including electronic processing means for controlling at least some of the process parameters.

8. A portable film processing unit according to claim 1, wherein said electronic processing means comprises a microcomputer.

* * * * *